US007314227B2

(12) United States Patent
Sanders

(10) Patent No.: US 7,314,227 B2
(45) Date of Patent: Jan. 1, 2008

(54) GLIDING BOARD WITH VIBRATION-ABSORBING LAYER

(75) Inventor: Doug Sanders, Seattle, WA (US)

(73) Assignee: K-2 Corporation, Seattle, WA (US)

( * ) Notice: Subject to any disclaimer, the term of this patent is extended or adjusted under 35 U.S.C. 154(b) by 295 days.

(21) Appl. No.: 11/005,313

(22) Filed: Dec. 6, 2004

(65) Prior Publication Data

US 2005/0127639 A1 Jun. 16, 2005

Related U.S. Application Data

(60) Provisional application No. 60/527,519, filed on Dec. 5, 2003.

(51) Int. Cl.
*A63C 5/00* (2006.01)

(52) U.S. Cl. ..... 280/602; 280/609; 280/11.14; 280/14.22

(58) Field of Classification Search ..... 280/601, 280/602, 609, 610, 11.14, 14.21, 14.22
See application file for complete search history.

(56) References Cited

U.S. PATENT DOCUMENTS

| | | | | |
|---|---|---|---|---|
| 4,405,149 | A * | 9/1983 | Piegay | 280/602 |
| 4,627,635 | A * | 12/1986 | Koleda | 280/602 |
| 5,000,475 | A * | 3/1991 | Gagneux et al. | 280/602 |
| 5,002,300 | A * | 3/1991 | Pascal et al. | 280/602 |
| 5,033,765 | A * | 7/1991 | Cagneux et al. | 280/602 |
| 5,035,442 | A * | 7/1991 | Arnsteiner | 280/602 |
| 6,217,041 | B1 | 4/2001 | Hauser et al. | |
| 6,612,605 | B2 | 9/2003 | Andrus et al. | |

FOREIGN PATENT DOCUMENTS

| | | |
|---|---|---|
| FR | 2 703 257 A1 | 10/1994 |
| WO | WO 00/30721 A1 | 6/2000 |
| WO | WO 02/056978 A1 | 7/2002 |

* cited by examiner

*Primary Examiner*—Christopher P. Ellis
*Assistant Examiner*—Brian Swenson
(74) *Attorney, Agent, or Firm*—Christensen O'Connor Johnson Kindness PLLC

(57) ABSTRACT

A gliding board such as a snowboard (100) having a core (130), a lower structural layer (132), an upper structural layer (134), a base element (138) attached under the lower structural layer, and a metal edge piece (136). A vibration-absorbing panel (120) is attached to the outer surface of the upper structural layer and a protective layer (140) is disposed over the vibration-absorbing panel and the upper structural layer. The vibration-absorbing panel is disposed in the binding attachment region (110) of the snowboard and is an integral and nonremovable part of the snowboard. The upper structural layer may include a recessed portion (235) that is sized to receive the vibration-absorbing panel, whereby the top surface of the snowboard does not have any protrusions. The snowboard includes an array of threaded inserts (152) for selective positioning and attachment of the binding base plate (150) to the snowboard over the vibration-absorbing panel.

13 Claims, 2 Drawing Sheets

GLIDING BOARD WITH VIBRATION-ABSORBING LAYER

CROSS-REFERENCE TO RELATED APPLICATION

This application claims the benefit of Provisional Application No. 60/527,519, filed Dec. 5, 2003, the benefit of which is hereby claimed under 35 U.S.C. § 119.

FIELD OF THE INVENTION

The present invention is related to the construction of gliding boards for sporting activities and, more particularly, to the design of snowboards.

BACKGROUND OF THE INVENTION

Winter sports activities such as skiing and snowboarding enjoy a great popularity throughout the world. The ease and enjoyment of participating in these sports have improved significantly with continued improvements in the design and construction of the requisite equipment. For example, innovations in boots and bindings used in winter sports have made remarkable advances, enhancing safety, capabilities, and comfort for the users.

The gliding boards themselves, i.e., skis and snowboards, have also improved, benefiting from advances in materials, manufacturing methods, and analytical models. Current skis and snowboards, for example, typically are constructed with an inner core formed of a wood and/or polymeric foam. The core may be sandwiched between or encased by one or more load-carrying structural layers. The structural layers are conventionally formed of composite materials, such as glass, carbon, or polyaramide fiber reinforced resins. Typically, a protective layer is provided over an upper surface of the structural layer and a gliding base element is affixed beneath the lower surface of the structural layer. The protective layer may include a decorative aspect to provide the snowboard with aesthetic appeal. One or more edge member(s), usually made from metal such as steel or titanium, is provided along the lower perimeter of the board, generally having a lower surface that is coplanar with the gliding base element.

A binding assembly mounts to the gliding board—for example, by bolting into inserts that may be formed integrally into the gliding board. Several types of bindings are available and different bindings may be suitable for different riding styles. For example, strap bindings are the most popular binding system in snowboarding due to their adjustability and secure and comfortable attachment. Strap bindings, however, can be hard to get into and out of. Step-in bindings are easier to get into and out of and have become increasingly popular. Other bindings, such as flow-in bindings, plate bindings, and baseless bindings are also available and may be particularly suited to specific classes of riders, such as alpine racers, halfpipe and park riders, and/or freestylers. Generally, bindings can be mounted on a snowboard in different positions, allowing the user to adjust the stance width, stance angle, and centering. Typically, a user may desire to reposition the bindings—for example, to accommodate differing riding styles and/or snow conditions or as the riders skills improve.

Snowboarding and skiing can generate significant vibrations that transmit through the gliding board and binding and into the rider's boots and feet. The vibrations can interfere with the rider's comfort and enjoyment of the sport. To reduce the vibrations transmitted to the user, sometimes a separate, elastomeric vibration-absorbing panel is installed on top of the snowboard between the binding and the snowboard. The use of separable vibration panels, however, has several disadvantages. For example, the vibration panel is at least partially exposed to the elements, which can cause the elastomeric panel to deteriorate and may require periodic replacement of the vibration panel. Also, if a rider desires to adjust the bindings to a different position, the task is complicated by also needing to reposition the vibration panel and may result in improper placement of the panel. This can be particularly inconvenient if the rider desires to adjust the binding position while on the slopes. Another disadvantage in some circumstances is that the vibration panel raises the binding with respect to the gliding board surface, which may interfere with the rider's ability to feel and control the board.

There remains a need, therefore, for an improved vibration suppression means for snowboards, skis and the like.

SUMMARY OF THE INVENTION

A gliding board construction is disclosed having a core that is substantially encased by a structural assembly, including an upper structural layer that substantially covers the upper surface of the core and a lower structural layer that substantially covers the bottom surface of the core. The upper structural layer includes an outer surface that defines a binding attachment region where the bindings are selectively positionable on the gliding board and a peripheral region that is not intended to receive the bindings. A vibration-absorbing panel is attached to the outer surface of the upper structural layer in the binding attachment region. A protective layer covers the outer surface of the upper structural layer, including the vibration-absorbing panel, such that the vibration-absorbing panel is an integral portion of the gliding board. A base element and edge piece define the undersurface of the gliding board.

In an embodiment of the invention, the vibration-absorbing panel is disposed only over the binding attachment region of the snowboard.

In an embodiment of the invention, the upper structural layer includes a recessed portion that is sized and shaped to receive the vibration-absorbing panel, such that the upper surface of the gliding board is substantially flat in the transverse direction.

In an embodiment of the invention, the vibration-absorbing panel includes a forward portion and a separate rearward portion.

The present invention may be practiced with gliding boards made using cap construction or with snowboards made using laminated construction methods.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings, wherein.

DETAILED DESCRIPTION OF THE PREFERRED EMBODIMENT

Figure 1:
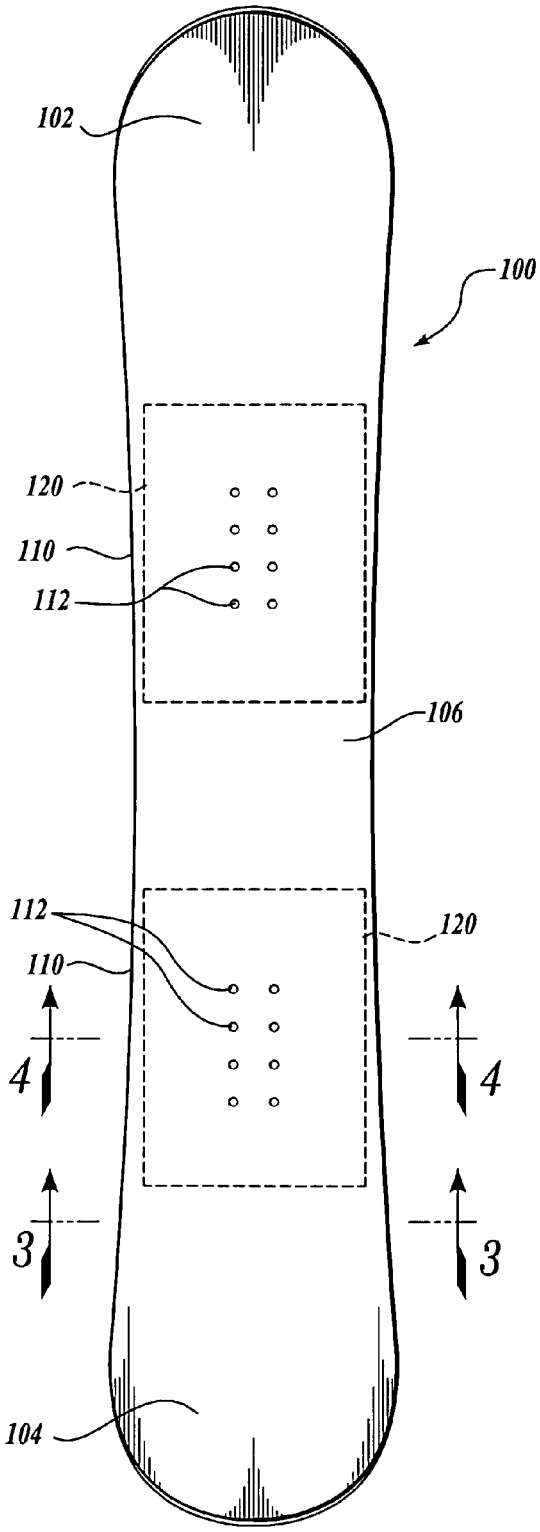
FIG. 1 is a top view of a snowboard constructed in accordance with the present invention.
Figure 2:
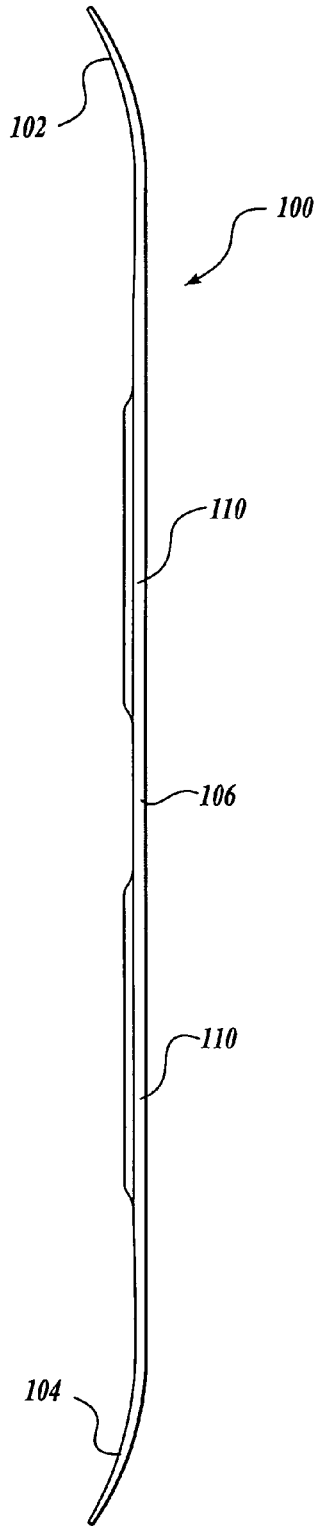
FIG. 2 is a side view of the snowboard shown in FIG. 1.

Refer now to the figures, wherein like numbers indicate like parts throughout the figures. FIG. 1 shows a plan view and FIG. 2 shows a side view of a snowboard 100, made in accordance with the present invention. It will be appreciated that, although a snowboard is shown, the present invention is generally applicable other gliding boards, such as skis. The snowboard 100 includes a forward nose section 102, a rearward tail section 104, and an intermediate waist section 106. The waist section 106 includes forward and rearward spaced-apart binding attachment regions 110, generally at opposite ends of the waist section 106, and that are adapted to receive bindings (not shown) for attaching the rider's boots (and hence the rider) to the snowboard 100. Each of the binding attachment regions 110 includes a plurality of apertures 112 that preferably provides access to internally-threaded metal inserts (not shown in FIG. 1) installed in the snowboard 100. The apertures 112 preferably, but not necessarily, conform to an industry-standard array, such that conforming bindings can be readily attached in a number of different positions onto the snowboard 100.

Figure 3:
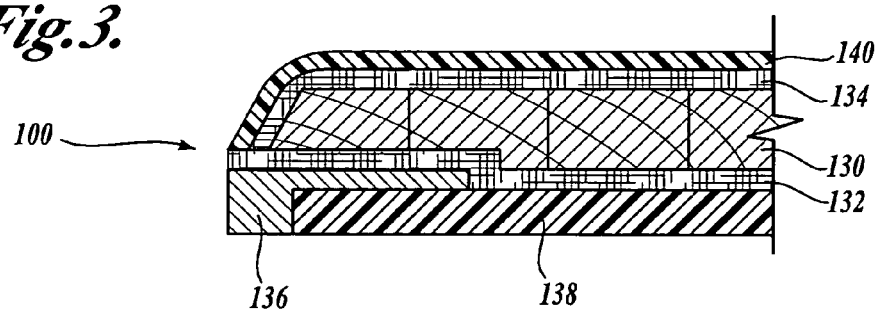
FIG. 3 is a cross-sectional view of the snowboard shown in FIG. 1, taken through lines 3-3.

FIG. 3 is a cross-sectional view of the snowboard 100, taken through line 3-3 in the rearward tail section 104. As shown in FIG. 3, the snowboard 100 is generally of cap construction, having a lightweight core 130 that may be formed, for example, from wood or from a polymeric foam. A lower structural layer 132 is bonded or otherwise attached to the bottom of the core 130 and an upper structural layer 134 is attached to the top of the core 130, providing a relatively rigid beam structure. The lower structural layer 132 and upper structural layer 134 may be formed, for example, from a composite material—typically a fiberglass and resin material—as is well known in the art. An edge preferably extending all the way around the outer edge of the snowboard 100. The edge piece 136 is preferably formed from steel or titanium, but may be of any suitably rugged material. A gliding panel or base element 138 is bonded to the bottom of the lower structural layer 132, disposed inboard of a portion of the edge piece 136. Suitable materials for the base element are known in the art, including, for example, a low friction material such as ultra-high molecular-weight polyethylene available under the trade name P-Tex®. A top sheet or protective layer 140 is bonded to the top of the upper structural layer 134. The protective layer 140 is preferably a transparent or translucent thermoplastic—for example, a polyurethane—that substantially covers the top of the snowboard 100 and that may include a decorative pattern, design, or figure (not shown), typically backprinted thereon.

Figure 4:
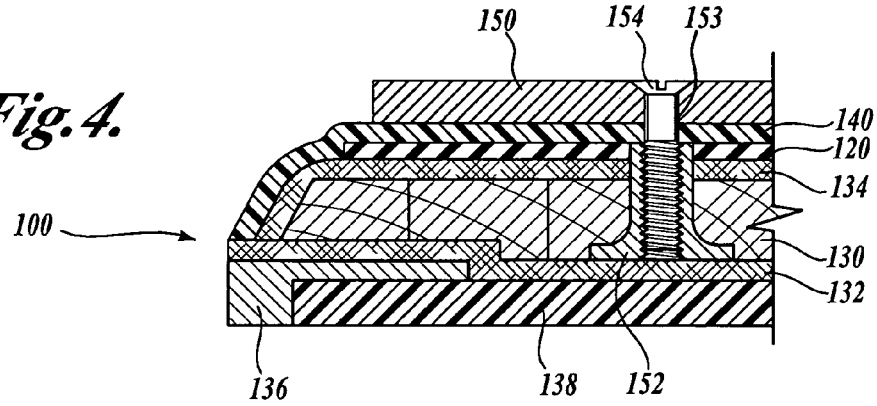
FIG. 4 is a cross-sectional view of the snowboard shown in FIG. 1, taken through lines 4-4.

As seen most clearly in FIG. 4, which shows a cross-sectional view of the snowboard 100 through line 4-4 taken through the rearward binding attachment regions 110, a vibration absorbing panel 120 is fixedly incorporated into the snowboard 100 between the protective layer 140 and the upper structural layer 134. Referring again to FIG. 1, the forward nose section 102, rearward tail section 104 and, optionally, an intermediate portion of the waist section 106 are peripheral to the binding attachment regions 110 and, in the preferred embodiment, these peripheral areas do not include a vibration-absorbing layer. The vibration-absorbing panels 120 are preferably made from a pliable elastomeric material.

As shown in FIG. 4, a binding disk or base plate 150 is selectively attached to the snowboard 100 using attaching hardware—for example, flat head screws 154 that extend through apertures 153 in the base plate 150 to engage internally threaded metal inserts 152 provided in the snowboard 100. Typically, threaded inserts 152 are provided that extend through the core 130 and upper structural layer 134. The threaded inserts 152 are generally provided in a standard spaced array (for example, as indicated by the apertures 112 in FIG. 1) and the base plate 150 is generally provided with apertures 153 that are adapted to permit the rider to position and orient the binding in a number of different desired positions. It will be appreciated that the desired configuration at any particular time may vary, depending on the type of riding to be undertaken, the snow conditions, and the rider's condition and mood.

It will also be appreciated that, in conventional snowboards having no integral vibration-absorbing panel 120, the binding plate 150 is attached directly to the protective layer 140 that is bonded to the rigid upper structural layer 134, resulting in a stiff and hard layer in contact with the binding, thereby transmitting the snowboard vibrations efficiently into the binding, resulting in an uncomfortable ride. In the embodiment shown in FIG. 4, the vibration-absorbing panel 120 is interposed between the upper structural layer 134 and the protective layer 140, whereby the vibrations from the snowboard are dampened prior to encountering the binding.

The vibration-absorbing panel 120 is incorporated integrally into the snowboard 100 and completely covered by the protective layer 140. The vibration-absorbing panel 120 is therefore protected from the moisture and other external elements and is not directly in contact with the binding itself. It will be appreciated by the artisan that because the vibration-absorbing panel 120 is protected, the designer's options in selecting suitable materials is broader than what would be suitable for external, e.g. unprotected, elastomeric panels.

Figure 5:
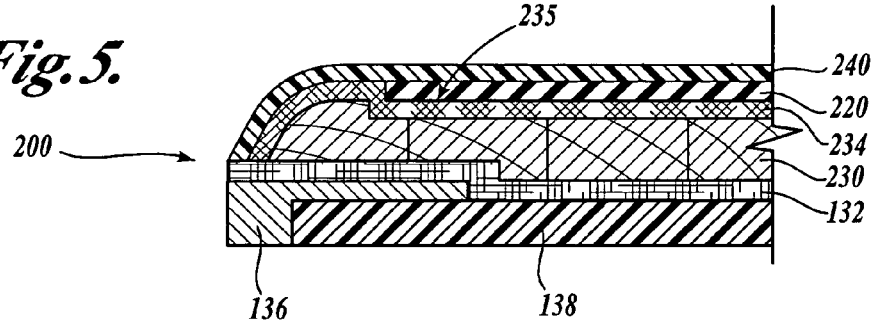
FIG. 5 is a cross-sectional view of an alternative embodiment of a snowboard similar to that shown in FIG. 1, wherein the upper structural layer includes a recessed portion adapted to accommodate the vibration-absorbing panel.

It will also be appreciated from FIGS. 1 and 4 that the vibration-absorbing panel 120 results in a protrusion on the upper surface of the snowboard 100. This may impact the user's optimal control of the snowboard 100 and may be undesirable for aesthetic reasons. FIG. 5 shows a cross-section through the binding attachment region for a first alternative embodiment of a snowboard 200. For clarity, the cross-section shown in FIG. 5 is not through the threaded inserts 152 and the binding base plate 150 is not shown. The snowboard 200 is similar to the snowboard 100 described above, including a core 230, a lower structural layer 132, an upper structural layer 234, an edge piece 136, a base element 138, and a vibration-absorbing panel 220 disposed between the upper structural layer 234 and a protective layer 240 and, therefore, common aspects of this embodiment will not be repeated. In the snowboard 200, the upper structural layer 234 includes an indented or recessed portion 235 defined on its upper surface, the recessed portion 235 being sized and shaped to accommodate the vibration-absorbing panel 220 such that the upper surface of the snowboard 200 does not include protrusions in the binding attachment regions 110 (FIG. 1). It should also be appreciated that recessing the vibration-absorbing panel 220 also decreases the susceptibility of the panel 220 to damage during transport and storage because the upper surface of the snowboard 200 is substantially flat in the transverse direction and, therefore, does not present any protrusions that might be more susceptible to damage.

Figure 6:
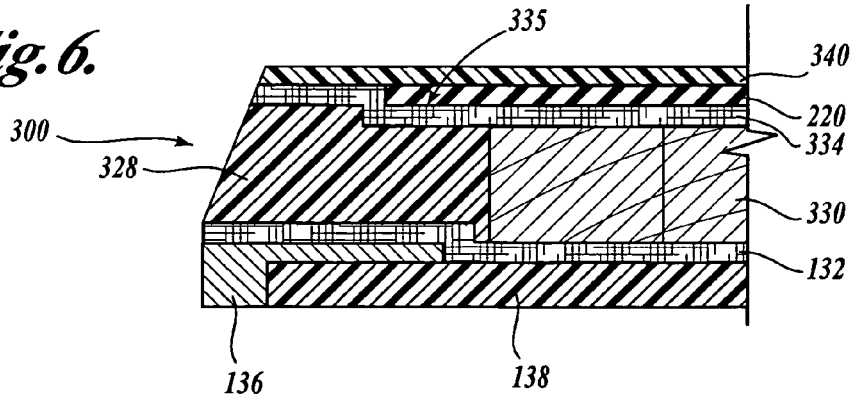
FIG. 6 is a cross-section view of an alternative embodiment of a snowboard similar to that shown in FIG. 5, wherein a sandwich construction method is employed.

Although FIGS. 4 and 5 disclose snowboards 100, 200 utilizing a cap construction design, it will be readily apparent that the present invention may also be practiced using alternative board construction methods, such as sandwich construction. FIG. 6 shows a cross-section taken generally through the binding attachment region of a snowboard 300, wherein the snowboard 300 is formed using a sandwich-type construction. In particular, the snowboard 300 includes a core 330, a lower structural layer 132, an upper structural layer 334, an edge piece 136, a base element 138, and a vibration-absorbing panel 220 disposed between the upper structural layer 334 and a protective layer 340. Again, for brevity and clarity, aspects of the particular embodiment of the invention shown in FIG. 6 that are the same as the snowboard 100 of the first embodiment are generally not repeated here. In the sandwich construction snowboard 300, the upper structural layer 334 is not directly in contact with the lower structural layer 132, at least in the waist section of the snowboard 300. A sidewall member 328 may be provided along at least a portion of the periphery of the snowboard 300, between the outer edges of the upper structural layer 334 and lower structural layer 132. Of course, the sidewall member 328 may not extend around the nose section 102 and tail section 104 (see FIG. 1) and may taper at the ends, such that the forward and rearward portions of the structural layers 334, 132 meet at the distal portions.

In the currently preferred embodiment shown, the upper structural member 334 includes a recessed portion 335 that is sized to accommodate the vibration-absorption panel 220. The vibration-absorbing panel(s) 220, which is provided only at the binding attachment region 110, is therefore recessed or inlaid in the snowboard 300, such that the protective layer 340 may be substantially flat, providing the advantages discussed above.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A gliding board comprising:

a core having an upper surface and a lower surface;

an upper structural layer that substantially covers the upper surface of the core, wherein the upper structural layer includes an outer surface having a binding attachment region and a peripheral region, wherein the binding attachment region includes a recessed portion;

a lower structural layer that substantially covers the lower surface of the core;

a pliable vibration-absorbing panel attached in the recessed portion of the binding attachment region of the outer surface of the upper structural layer such that the vibration-absorbing panel does not substantially protrude in the binding attachment region;

a protective layer overlying the outer surface of the upper structural layer, the protective layer also overlying the vibration-absorbing panel; and a base element attached to the lower structural layer.

2. The gliding board of claim 1, wherein the vibration-absorbing panel includes a first portion and a second portion, and wherein the first and second portions are not contiguous.

3. The gliding board of claim 1, wherein the upper structural layer is cap-shaped and sized to receive the core such that the upper structural layer defines sidewalls for the gliding board.

4. The gliding board of claim 1, further comprising a pair of sidewall members disposed along a periphery of the gliding board between the upper structural layer and the lower structural layer.

5. The gliding board of claim 1, wherein the core is formed primarily from a material selected from wood and polymeric foam.

6. The gliding board of claim 5, wherein the upper structural layer and the lower structural layer are formed primarily from a reinforced composite material.

7. A gliding board comprising:

a core substantially encased by a structural assembly including an upper structural layer and a lower structural layer, wherein the upper structural layer includes a forward binding attachment region having a recessed portion, a rearward binding attachment region having a recessed portion, and a peripheral region;

a first pliable vibration-absorbing panel disposed in the recessed portion of the forward binding attachment region of the upper structural layer and a second pliable vibration-absorbing panel disposed in the recessed portion of the rearward binding attachment region of the upper structural layer such that the vibration-absorbing panel does not substantially protrude in the binding attachment region;

a plurality of threaded inserts disposed through the core and the upper structural layer;

a protective layer affixed over and substantially covering the upper structural layer and overlying the first and second vibration-absorbing panels such that the vibration-absorbing panels are integral to the gliding board; and a base element and an edge element attached to the structural assembly and defining a bottom surface of the gliding board.

8. The gliding board of claim 7, wherein the upper structural layer is cap-shaped and sized to receive the core, such that the upper structural layer defines sidewalls of the structural assembly.

9. The gliding board of claim 7, wherein the structural assembly further comprises a pair of peripheral sidewall members between the upper structural layer and the lower structural layer.

10. The gliding hoard of claim 7, wherein the core is formed primarily from a material selected from wood and polymeric foam.

11. The gliding board of claim 10, wherein the upper structural layer and lower structural layer are formed primarily from a reinforced composite material.

12. A method for making a gliding board comprising the steps of:

forming a gliding board core having an upper surface and a lower surface;

attaching an upper structural layer to the core, substantially covering the upper surface of the core, the upper structural layer defining a recessed portion;

attaching a lower structural layer to the core, substantially covering the lower surface of the core;

attaching a base element and edge piece to the lower structural layer to define a lower surface of the gliding board;

attaching a pliable vibration-absorbing panel in the recessed portion of the upper structural layer at a binding attachment region of the upper structural layer such that the vibration-absorbing panel does not substantially protrude in the binding attachment region; and attaching a protective layer to the upper structural layer substantially covering the upper structural layer and the vibration-absorbing panel.

13. The method of claim 12, wherein the upper structural layer is cap-shaped such that the upper structural layer defines structural sidewalls for the gliding board.

* * * * *